United States Patent [19]

Hoffman, Sr.

[11] Patent Number: 4,977,718

[45] **Date of Patent: * Dec. 18, 1990**

[54] BENT POSITION RETENTION FLEXIBLE CORNER BEAD STRIP

[75] Inventor: Dennis Hoffman, Sr., Palatine, Ill.

[73] Assignee: Pro Patch Systems, Inc., Palatine, Ill.

[ * ] Notice: The portion of the term of this patent subsequent to Jun. 6, 2006 has been disclaimed.

[21] Appl. No.: 352,756

[22] Filed: May 16, 1989

Related U.S. Application Data

[63] Continuation-in-part of Ser. No. 197,522, May 23, 1988, Pat. No. 4,835,925, which is a continuation-in-part of Ser. No. 88,796, Aug. 24, 1987, abandoned.

[51] Int. Cl.[5] ..... E04F 19/02; E04F 13/06

[52] U.S. Cl. ..... 52/288; 52/416

[58] Field of Search ..... 52/288, 416, 417, 287

[56] References Cited

U.S. PATENT DOCUMENTS 4,835,928 6/1989 Hoffman, Sr. ..... 52/288

*Primary Examiner*—James L. Ridgill, Jr.

*Attorney, Agent, or Firm*—Allegretti & Witcoff, Ltd.

[57] ABSTRACT

The present invention is directed to an improved flexible corner bead strip usable for reinforcing a drywall corner. The corner bead strip comprises first and second plastic strips each of which has a substantial longitudinal dimension and corresponding with the length of the drywall corner to be reinforced. Each of the first and second plastic strips also has a transverse dimension which defines a corner line formed from the respective central and abutting edges thereof. A flexible V-shaped hinge is disposed at the respective central and abutting edges of the first and second plastic strips forming a corner line to enhance retention of the first and second plastic strips in the bent position. A drywall compound adhering surface is formed and bounded by the exterior surface of the wings of the V-shaped hinge and the attached plastic strip surface which accommodating extends laterally thereacross for containing dry wall compound therewithin.

16 Claims, 2 Drawing Sheets

FIG. 1
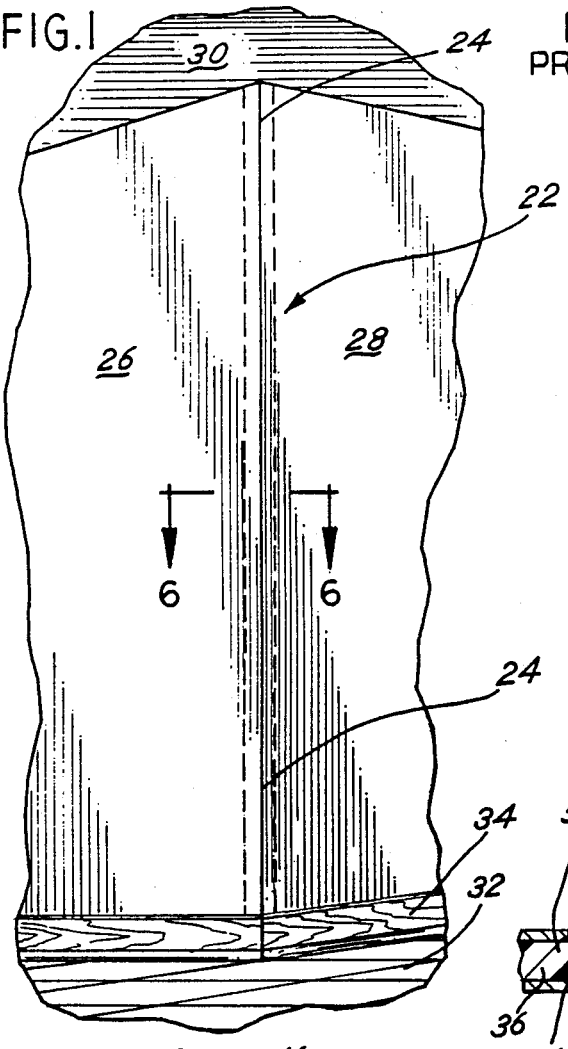
FIG. 2
PRIOR ART
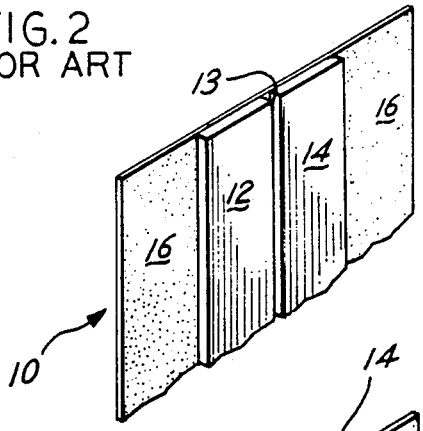
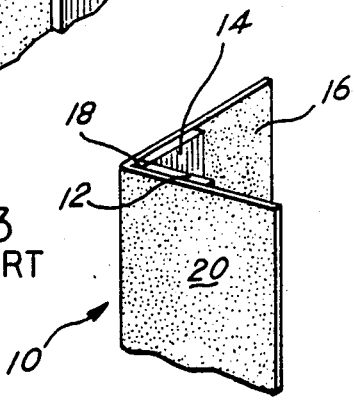
FIG. 3
PRIOR ART
FIG. 5
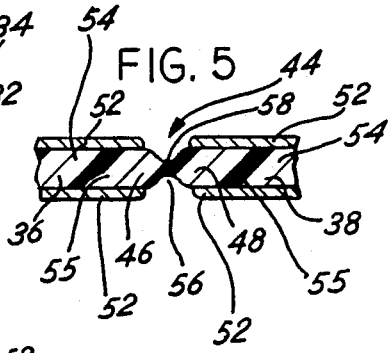
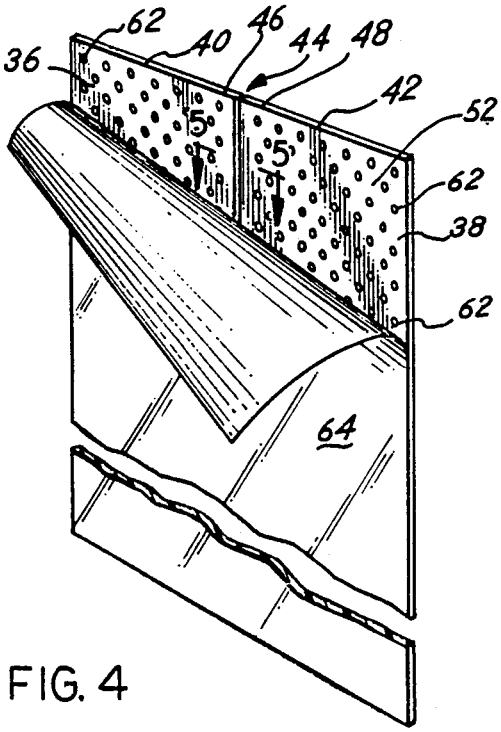
FIG. 4
FIG. 6
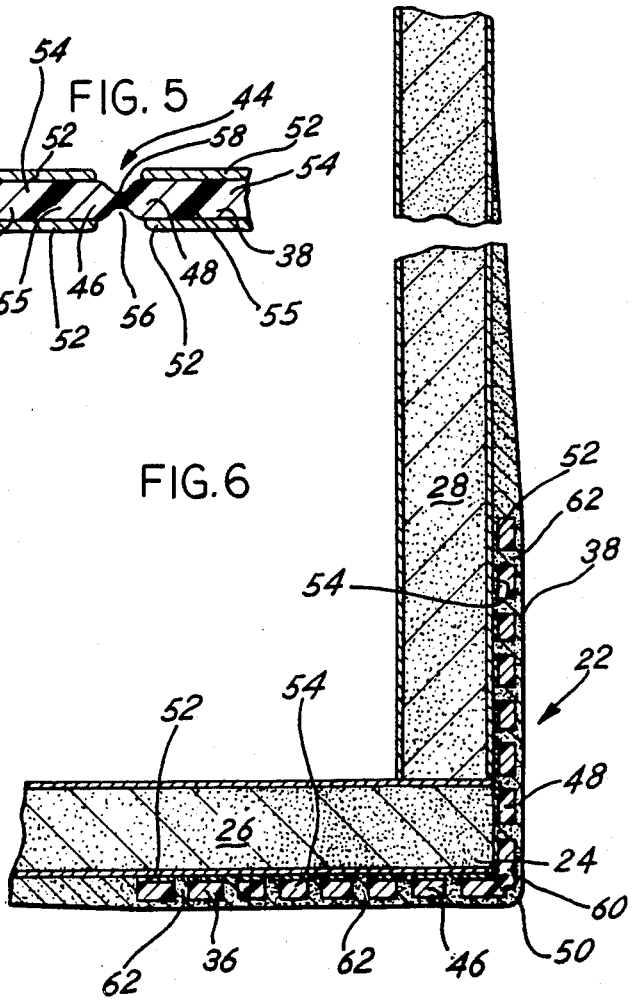

Fig. 7
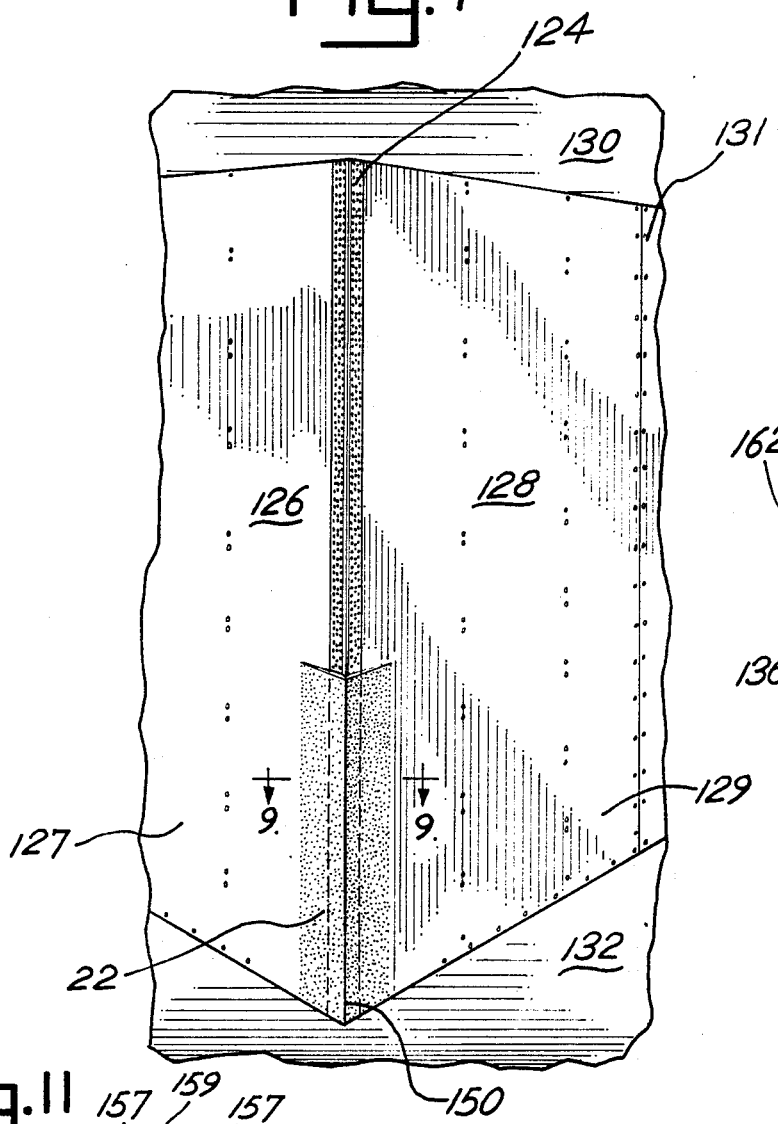
Fig. 8
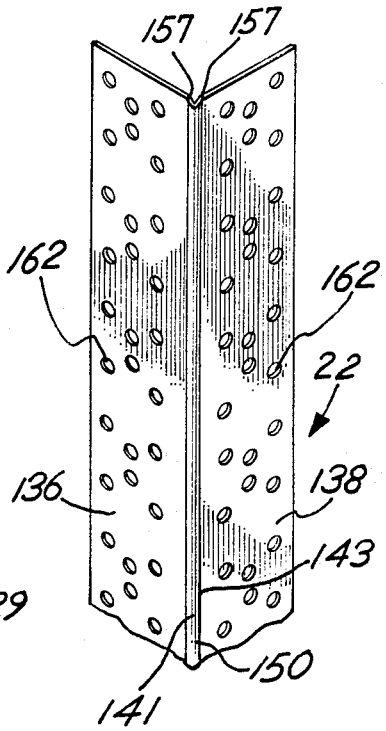
Fig. 11
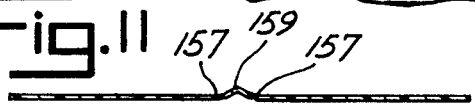
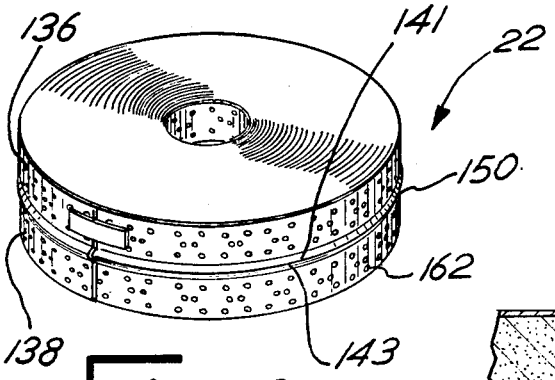
Fig. 10
Fig. 9
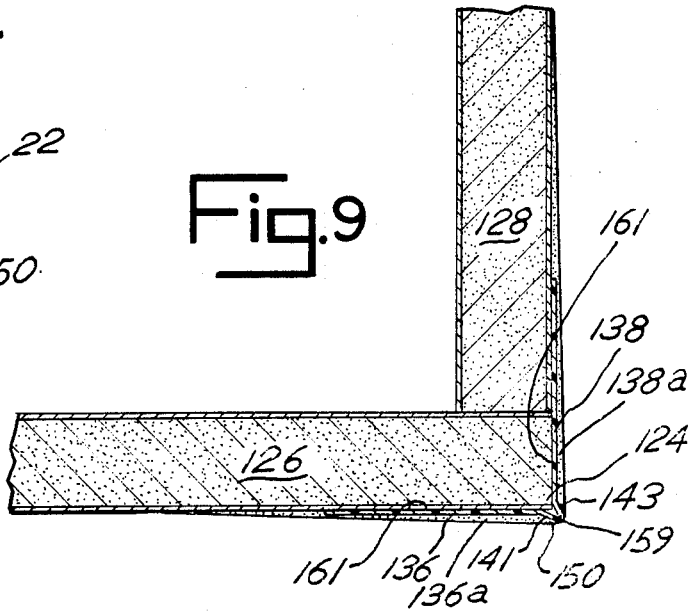

BENT POSITION RETENTION FLEXIBLE CORNER BEAD STRIP

BACKGROUND OF THE INVENTION

This application is a continuation-in-part application of Ser. No. 197,522, filed on May 23, 1988, now U.S. Pat. No. 4,835,925 issued June 6, 1989 which is a continuation-in-part of Ser. No. 088,796 filed on Aug. 24, 1987 now abandoned.

The present invention is directed in general to the drywall and drywall application arts, and more particularly to an improved flexible corner bead strip for reinforcing a drywall corner.

One embodiment of corner bead reinforcing strips of the prior art is set forth in U.S. Pat. No. 2,862,264 to Anthony Perna and is entitled "Reinforcement Strip For Reinforcing The Corners Of Drywalls And The Like." The reinforcement strips set forth in the prior art comprise two metallic strips formed of galvanized steel or aluminum and disposed side-by-side and with a narrow space therebetween. Such galvanized steel strips are borne upon and connected together by means of a carrier strip of heavy craft paper or fabric which is approximately 2 inches wide. Thus, such prior art reinforcement strips are and/or flexible and may be bent at any angle between approximately 270° and/or to less than 90°, and provides a number of advantages over such prior art devices.

Nonetheless, there are a number of disadvantages associated with the structure of prior art reinforcement strips. One such problem is occasioned by the fact that the prior art device is necessarily an (at least) three piece structure. Also, additional machinery, care and expense are involved because of the multiple steps necessary to produce and assemble the component parts of such prior art devices. Yet also, for example, the adhesive utilized to secure the galvanized steel reinforcing strips to the carrier strip of paper or fabric has a tendency to delaminate, either prior to application of such prior art device onto a corner for reinforcement thereof or afterwards, which renders application of drywall compound thereto difficult, inaccurate, messy and time-consuming—all of which decrease the productivity of the worker and the quality of his work product. Furthermore, such prior art reinforcing strips are not inexpensive. In addition, the corner formed by means of such prior art reinforcing strip, and especially for certain angles of corners, is not optimally as sharp as the corner might be. Yet additionally, such prior art corner reinforcement strips are relatively expensive in the cost of manufacture, and in the costs, expenses and difficulties in utilization. In further addition, certain prior art devices have been designed to have insufficiently thick services for the application of drywall compound thereto to provide for ease of smoothing out to conceal the edges of the corner bead apparatus, and to feather such compound in a facilitated manner, and also preferably more drywall compound in a thicker mass towards the corner, and gradually less away from the corner.

Yet further, certain prior art materials have been foldable, but have inherently retained a "memory," which caused the material to spring from its folded position in which it could be applied to either an interior or exterior corner, to return to its rolled disposition, thereby rendering such prior art material unsuitable for a direct application to an exterior or interior corner. In some such embodiments, there has been additional difficulty in folding the material into its installable array and/or into the disposition of a standable unit.

Yet additionally, certain prior art devices have required gluing, or have required nailing, but have been insufficiently versatile for the utilization of various attachment means.

Based upon the above deficiencies, defects and difficulties with prior art corner reinforcement strips, it is a material object of the improved flexible corner bead strip of the present invention to materially alleviate such prior art problems.

A multiplicity of further advantages associated with use of the improved flexible corner bead strip of the present invention will become apparent to those of ordinary skill in the art upon review of the subsequent background of the invention, brief description of the drawing, detailed description of preferred embodiments, appended claims and accompanying drawings.

SUMMARY OF THE INVENTION

The improved flexible corner bead strip of the present invention is of the variety for reinforcing drywall corners and/or other corners requiring reinforcement. The corner bead strip hereof because of the cooperative nature of the elements thereof may be formed as a unitary device, but however comprises first and second plastic strips each of which has a substantial longitudinal dimension and corresponding with the length of the drywall corner to be reinforced.

Each of the first and second plastic strips also has a transverse dimension which defines a corner line formed from the respective central and abutting edges thereof. A flexible joint is disposed at the respective central and abutting edges of the first and second plastic strips forming a corner line, and may be formed of the same plastic material thereof. The corner line functions to substantially flexibly secure the first and second plastic strips to be bend at an angle corresponding with the angle of the drywall corner for securement thereto, thereby to reinforce the drywall corner. An adhesive layer is also disposed on at least one side of the first and second plastic strips. A drywall compound adhering surface is also contained upon at least one side of the first and second plastic strips, and a side opposite an adhesive layered side in some embodiments.

A further improved embodiment of the flexible corner bead strip of the present invention has included features to promote retention thereof in the bent position suitable for installation on an inner corner or for disposition on an exterior corner. The structure which has permitted such application compromises a plastic hinge which is substantially V-shaped in transferse cross-section to enhance retention of the first and second plastic strips in the bent position.

The first and second plastic strips may comprise vinyl or other suitable plastics, and may have a transverse dimension of approximately at least one inch. Such improved flexible corner bead strip may be disposed into a rolled state for storage and packaging prior to use thereof.

BRIEF DESCRIPTION OF THE DRAWING

Various preferred embodiments of the improved flexible corner bead strip apparatus of the present invention are set forth in the accompanying drawing along with a comparison of the above disclosed and discussed prior art devices for clarity and emphasis of various advantages thereover, and in which:

FIG. 1 is a perspective view of the improved flexible corner bead strip of the present invention (shown in dotted lines) and as applied to a corner and showing drywall covering the first and second plastic strips defining a corner line from the respective central and abutting edges thereof to form a smooth and sharp-edged corner;

FIG. 2 is a perspective fragmented view of a prior art reinforcement strip showing two metallic (galvanized steel or aluminum) reinforcing strips disposed in side-by-side array on a paper or fabric carrier strip in parallel relation to each other and longitudinally of such carrier strip;

FIG. 3 is a further fragmented perspective view of the reinforcement strip of the prior art shown in disposition for application to a corner to be reinforced, and showing such metal reinforcing strips defining a corner reinforcement edge and depicting the opposite side of the carrier strip having a substantially smooth surface thereon for application of drywall compound hereto;

FIG. 4 is a fragmented perspective view of the improved flexible corner bead strip of the present invention showing the first and second plastic strips disposed in side-by-side relationship prior to bending along the centrally disposed corner line thereof, to form an angle corresponding to that of the corner to be reinforced, and further showing disposed over the adhesive containing surface thereof a release sheet, which permits the side-by-side disposed first and second plastic strips to be rolled into a rolled format for packaging and storage prior to application thereof.

FIG. 5 is a greatly magnified and fragmented transverse cross-sectional view taken along line 5—5 of FIG. 1 and showing one embodiment of flexible joinder means disposed at the respective and central abutting edges as for forming the corner line for the substantially flexibly securing the first and second plastic strips together, and showing further an embodiment wherein mutually facing grooves are disposed on opposite sides of the corner line for defining a hinge such that the corner bead strip can be bent to accommodate either convex or concave corners;

FIG. 6 is a very greatly magnified transverse cross-sectional view taken along 6—6 of FIG. 1 and showing a drywall corner with the improved flexible corner bead strip of the present invention installed thereon and covered with drywall compound to form smooth, flat walls with a sharp corner therebetween;

FIG. 7 is a perspective view of an alternative embodiment of the improved flexible corner bead strip of the present invention as shown installed upon an outside drywall corner;

FIG. 8 is an enlarged perspective view of the embodiment of the improved flexible corner bead strip of the present invention of the alternative embodiment of FIG. 7, showing the first and second plastic strips thereof connected by a plastic hinge which is substantially V-shaped in transfer cross-section to enhance retention of the first and second plastic strips in the bent position, and to provide a surface for thicker application of drywall compound near the exterior corner and tapering in thickness laterally away therefrom;

FIG. 9 is an enlarged transferse cross-sectional view of the alternative embodiment of the improved corner bead strip of the present invention as shown in FIG. 7 and taken along lines 9—9 thereof, as installed on such exterior drywall corner, and further showing application of drywall compound thereto which is greater in thickness in areas near the corner, and which tapers in thickness away therefrom;

FIG. 10 is a perspective view of a rolled strip of the alternative embodiment of the improved flexible corner bead strip of the present invention as shown in FIG. 7, and further showing the V-shaped hinge thereof; and FIG. 11 is an enlarged transverse cross-sectional view of the improved flexible corner bead strip of the present invention in the alternative embodiment of FIG. 7 hereof as disposed in a flattened-out array, such as shown in FIG. 10 in the rolled format thereof.

DETAILED DESCRIPTION OF PREFERRED EMBODIMENTS

The improved flexible corner bead strip of the present invention is principally usable for reinforcing a drywall corner. The corner bead strip hereof comprises first and second plastic strips. Each of the first and second plastic strips has a substantial longitudinal dimension which corresponds with the length of the drywall corner to be reinforced, and may be cut to length from a storage roll of such material to so correspond. Each of the first and second plastic strips has a transverse dimension which defines a corner line formed from the respective central and abutting edges of each of the first and second plastic strips.

A flexible joinder means in the form in some preferred embodiments of a hinge is disposed at the respective central and abutting edges forming the corner line. The flexible joinder means functions to substantially flexibly secure the first and second plastic strips together, and also permits each of the first and second plastic strips to be bent at a selected angle corresponding to the angle of the drywall corner for securement thereto to reinforce the drywall corner.

Adhesive means are disposed on at least one side of the first and second plastic strips for permitting application thereof to the drywall corner to be reinforced and for adhesion of such corner bead strip thereto.

Drywall compound adhering surface means are disposed upon at least one of the first and second plastic strips for adhesion of the drywall compound to the exposed surface in situ of the first and second plastic strips. Thus, the improved flexible corner bead strip of the present invention functions whereby the drywall corner may be readily, stably and securely reinforced regardless of the angle of the corner.

In preferred embodiments of improved flexible corner bead strip of the present invention, the first and second plastic strips may be formed from a vinyl plastic.

Also in alternative preferred embodiments, such first and second plastic strips may be formed from a polypropolyene polymer, or other plastic having substantial rigidity, to function for forming a corner bead structure to hold and support the drywall surfaces.

In these and other preferred embodiments, the flexible joinder means may comprise a plastic hinge which may be co-extruded, co-molded, or otherwise co-formed with the rigid polymeric material used for forming the plastic strips. This polymeric material is formed of a polymeric material having substantial flexibility in both lateral directions to function as a hinge, and may be formed of ethylene vinyl acetate polymer (EVA) or other such substantially flexible polymeric materials.

In alternative embodiments, other plastics having appropriate properties of flexibility, strength and stability may be utilized. These selected plastics may be determined by those of ordinary skill in the art without undue experimentation.

In these and other preferred embodiments, the first and second plastic strips each have a transverse dimension which may be approximately at least one inch, although other sizes and formats may be useful in various different environments.

The flexible joinder means of the improved flexible corner bead strip of the present invention may comprise a weakening in the plastic material of the first and second plastic strips corresponding to the corner line, thereby to permit a fold along such corner line.

Such flexible joinder means may comprise a corner groove disposed within at least one surface of the first and second plastic strips corresponding to the corner line. A supplemental groove means may be disposed at and along the corner line and in the surface on the opposite side from the corner groove for providing supplemental flexibility for bending in both directions and for accommodation of both convex (outside) and concave (inside) corners.

Such flexible joinder means or hinge means may comprise at least one corner slit cut into the surface of the plastic material of the first and second plastic strips to define a corner line thereof. Such corner slit may be preferably cut into the surface of the plastic material for a substantial depth, but in preferred embodiments not all the way through such plastic material. In yet further alternative embodiments, such slit may be discontinuous in the form of a dotted line or scoring, some of which might extend completely through the plastic material in portions thereof.

The drywall compound adhering surface means of the improved flexible corner bead strip of the present invention may preferably comprise a plurality of drywall compound receiving and adhering elements disposed within the first and second plastic strips. Such drywall compound receiving and adhering elements may in preferred embodiments comprise apertures disposed within and/or through the first and second plastic strips. Such apertures may be molded in, or in preferred embodiments may be stamped into the plastic material.

The adhesive means of the improved flexible corner bead strip of the present invention are preferably disposed upon a first side of the first and second plastic strips. In these and other embodiments, the drywall compound adhering surface may be disposed upon the opposite side of the first and second plastic strips.

In other embodiments, the adhesive means may be disposed upon both sides of the first and second plastic strips, and in such embodiments and other embodiments the flexible joinder means may be disposed for substantial flexing of the first and second plastic strips towards each other, and in some embodiments in one direction only. In these embodiments the selection of such first and second plastic strips towards each other are at angles of between approximately 0° through 180°, but not in the opposite direction and between the angles of approximately 180°-360°. In such embodiments, the corner bead strip may be used for convex (exterior) and or concave (interior) corners by selecting either side for disposition onto the corner surface for reinforcement thereof.

In some preferred embodiments, release sheet means are provided for releasably and protectively disposing upon and over the adhesive means and to be peeled off prior to application of the corner bead strip to the corner to be reinforced.

In preferred embodiments of the improved flexible corner bead strip of the present invention the first and second plastic strips are maintained in side-by-side disposition and the length of the first and second strips is further disposed into a rolled state for storage prior to use thereof.

In certain additional preferred alternative embodiments, the flexible corner bead strip of the present invention is especially adapted for retention in the bent position. A preferred structure which promotes such retention in the bent position comprises a plastic hinge which is substantially V-shaped in transferse cross-section to enhance retention of the first and second plastic strips in the bent position. In these preferred embodiments, the V-shaped plastic hinge is attached to each of the first and second plastic strips at the distal portion of the wings of the V-shape. In such alternative preferred embodiments, the exterior surface of the wings and the exterior surface of the attached plastic strip together function to define (in the bent position and as installed on the exterior corner) a drywall compound adhering surface means. Such V-shaped plastic hinge is preferably formed of the same plastic material as that of the first and second plastic strips.

The drywall compound adhering surface is preferably formed to be deeper in areas immediately adjacent to the wings of the V-shaped hinge (i.e., and also immediately adjacent to the drywall corner upon which it is installed). Such drywall compound adhering surface tapers to a shallower depth in areas disposed laterally away from the wings of the V-shaped hinge. The result of such structure is to provide for a thicker application of the drywall compound near the exterior corner and tapering in thickness laterally away therefrom. Such taper in preferred embodiments is substantially gradually tapering from the drywall corner upon which the apparatus is installed away therefrom and away from the V-shaped hinge thereof.

Such V-shaped hinge is formed in some embodiments from embossing the V thereof into the material from which the first and second plastic strips are formed. Such V-shaped hinge is preferably formed from lines of weakness which are disposed to extend substantially in parallel array and extending longitudinally on the material from which the first and second plastic strips are formed. In such embodiments, a generally centrally disposed line of weaknesses disposed in the material from which the first and second plastic strips to form the bottom of the V-shaped hinge. Also in such preferred embodiments a pair of generally laterally disposed lines of weakness are disposed at substantially equal lateral distances from the centrally disposed line of weakness to define the top extent of the wings of the V-shaped hinge. Also in these preferred embodiments, the generally centrally disposed line of weakness may preferably be disposed into one surface of the material from which the first and second plastic strips are formed. In the same and other similar embodiments, the pair of generally laterally disposed lines of weakness is also disposed into the opposite surface of the material from which the first and second plastic strips are formed.

Each of the centrally disposed and the pair of generally laterally disposed lines of weaknesses is formed as a longitudinally extending indentation within the respective surfaces (i.e., front and back surfaces) of the material from which the first and second strips are formed. In these and other preferred embodiments, adhesive means may be applied to at least one side of the first and second plastic strips for permitting application thereof to the corner to be reenforced and for adhesion thereto. Alternatively, the first and second plastic strips may be attached by other means to the drywall, such as by nailing.

Referring now to the drawing and to FIGS. 2 and 3 in particular, a prior art reinforcement strip generally 10 is depicted, in the flat storage format in FIG. 2, and in the bent format, as in situ, in FIG. 3 as shown in FIG. 2. Such prior art reinforcement strip 10 comprises two metallic reinforcing strips 12, 14 formed of substantially non-corroding material such as stainless steel or aluminum. Such metallic reinforcing strips 12, 14 disposed separated by a substantially uniform space 13, and in side-by-side array and substantially parallel upon and generally longitudinally of carrier strip 16 which may be formed of paper or fabric. In FIG. 3, of such prior art reinforcing strip 10 is shown in position for application to a corner to be reinforced (not shown). Such metallic reinforcing strips 12, 14 define a corner reinforcement edge 18. Such carrier strip 16 is shown to have a substantially smooth rear surface 20 thereof for ready application of drywall compound thereto (not shown).

As shown in FIGS. 1, 4, 5 and 6, the improved flexible corner bead strip of the present invention generally 22 is principally usable for reinforcing a drywall corner 24, as shown in the perspective view of FIG. 1. Such drywall corner 24 is formed from walls 26, 28 and is disposed between ceiling 30 and floor 32, and may be equipped with woodwork trim 34.

The corner bead strip 22 hereof comprises first and second plastic strips 36, 38. As shown in FIG. 4, each of first and second plastic strips 36, 38 has a substantial longitudinal dimension which corresponds with the length of the drywall corner 24 to be reinforced as shown in FIG. 1. Such improved flexible corner head strip 22 hereof may be cut to length from a storage roll of such material to so correspond, it being noted that the flexible corner bead strip as shown in FIG. 4 is rollable. Each of first and second plastic strips 36, 38 has a transverse dimension 40, 42 which defines a corner line generally 44 formed from the respective central and abutting edges 46, 48 of each of first and second plastic strips 36, 38.

As shown in FIG. 6, a flexible joinder means in the form in some preferred embodiments of a hinge 50 is disposed at the respective central and abutting edges 46, 48 forming corner line 44. The flexible joinder means functions to substantially flexibly secure first and second plastic strips 36, 38 together, and also permits each of first and second plastic strips 36, 38 to be bent at a selected angle corresponding to the angle of the drywall corner for securement thereto to reinforce drywall corner 24, as shown in FIG. 6. Adhesive means 52 are disposed on at least one side 54 of first and second plastic strips 36, 38 for permitting application thereof to drywall corner 24 to be reinforced and for adhesion of such corner bead strip 22 thereto. Drywall compound adhering surface means are disposed upon at least one of first and second plastic strips 36, 38 for adhesion of the drywall compound to the exposed surface in situ of first and second plastic strips 36, 38. Thus, the improved flexible corner bead strip 22 of the present invention functions whereby drywall corner 24 may be readily, stably and securely reinforced regardless of the angle of the corner.

In preferred embodiments of improved flexible corner bead strip 22 of the present invention, such first and second plastic strips 36, 38 may be formed from a vinyl plastic. In alternative embodiments, other plastics having appropriate properties of flexibility, strength and stability may be utilized. These selected plastics may be determined by those of ordinary skill in the art without undue experimentation.

As shown schematically in FIG. 1, in these and other preferred embodiments, first and second plastic strips 36, 38 each have a transverse dimension which may be approximately at least one inch.

The flexible joinder means of the improved flexible corner bead strip of the present invention may comprise a weakening in the plastic material of first and second plastic strips 36, 38 corresponding to the corner line 44, thereby to permit a fold along such corner line 44.

As shown in FIG. 5 in particular, such flexible joinder means may comprise a corner groove 56 disposed within at least one surface 55 of first and second plastic strips 36, 38 corresponding to corner line 44. A supplemental groove 58 may be disposed at and along corner line 44 and in the surface 54 on the opposite side from corner groove 56 for providing supplemental flexibility to the flexible joinder means. Such flexible joinder means may comprise means for substantially flexibly bending in both directions and for accommodation of both convex (exterior) and concave (interior) corners.

Such flexible joinder means or hinge means may comprise at least one corner slit 60 cut into surface 54 of the plastic material of first and second plastic strips 36, 38 to define a corner line thereof. Such corner slit 60 may be preferably cut into the surface of the plastic material for a substantial depth, but in preferred embodiments not all the way through such plastic material. In yet further alternative embodiments, such slit 60 may be discontinuous in the form of a dotted line or scoring.

The drywall compound adhering surface means of the improved flexible corner bead strip of the present invention may preferably comprise a plurality of drywall compound receiving and adhering elements disposed within first and second plastic strips 36, 38. More particularly, such drywall compound receiving and adhering elements may in preferred embodiments comprise apertures 62 disposed within and/or through first and second plastic strips 36, 38. Such apertures 62 may be molded in, or in preferred embodiments may be stamped into the plastic material.

The adhesive 52 of the improved flexible corner bead strip 22 of the present invention is preferably disposed upon a first side 54 of first and second plastic strips 36, 38. In these and other embodiments, the drywall compound adhering surface 55 may be disposed upon the opposite side of first and second plastic strips 36, 38.

In other embodiments, the adhesive 52 may be disposed upon both sides 54, 55 of first and second plastic strips 36, 38, and in such embodiments and other embodiments the flexible joinder means 56 may be disposed for substantial flexing of first and second plastic strips 36, 38 towards each other and in one direction only. In these embodiments, the disposition when installed of such first and second plastic strips 36, 38 towards each other is at angles of between approximately 0° through 180°, but not in the opposite direction and between the angles of approximately 181°–360°. In such embodiments, corner bead strip 22 hereof may be used for convex (exterior) and or concave (interior) corners by selecting either side for disposition onto corner 24 for reinforcement thereof.

In some preferred embodiments, release sheet means 64 are provided for releasably and protectively disposing upon and over the adhesive 52 and to be peeled off prior to application of corner bead strip 22 to the corner 24 to be reinforced.

In preferred embodiments of the improved flexible corner bead strip 22 of the present invention first and second plastic strips 36, 38 are maintained in side-by-side disposition and the length of first and second strips 36, 38 is further disposed into a rolled state for storage prior to use thereof.

Referring to FIGS. 7–11, certain additional preferred alternative embodiments of the flexible corner bead strip generally of the present invention are shown, wherein such improved bent position retention embodiments of the flexible corner bead strip 122 hereof are especially adapted for retention in the bent position as shown in FIG. 8 in upstanding disposition. Such flexible corner bead strip 122 is used in general for reinforcing a drywall corner 124 formed from walls 126, 128 disposed between a ceiling 130 and a floor 132, as shown in perspective view in FIG. 7 and in transverse cross-sectional view in FIG. 9. As shown in FIG. 7, walls 126, 128 are formed from sheets of drywall 127, 129 secured with nails 131.

The structure which promotes such retention in the bent position comprises a plastic hinge 150 which is substantially V-shaped in transferse cross-section to enhance retention of first and second plastic strips 136, 138 in the bent position. In these preferred embodiments, the V-shaped plastic hinge 150 is attached to each of the first and second plastic strips 136, 138 at the distal portion of the wings 141, 143 of the V-shape. In such alternative preferred embodiments, the exterior surface of wings 141, 143 and the exterior surface of the attached plastic strip 136 or 138 together function to define (in the bent position and as installed on the exterior corner 124) a drywall compound adhering surface **136*a*, 138*a*, as shown in FIG. 9. Such V-shaped plastic hinge 150 is preferably formed of the same plastic material as that of the first and second plastic strips 136, 138**.

Such drywall compound and adhering surfaces **136*a*, 138*a* are preferably formed to be deeper in areas immediately adjacent to wings 141, 143 of V-shaped hinge 150 (i.e., and also immediately adjacent to drywall corner 124 upon which it is installed). Such drywall compound adhering surfaces 136*a*, 138*a* taper to a relatively shallower depth at areas disposed laterally away from wings 141, 143 of V-shaped hinge 150. The result of such structure is to provide for a thicker application of the drywall compound near exterior corner 124 and tapering in thickness laterally away therefrom. Such drywall compound adhering surfaces 136*a*, 138*a*, may include apertures 162 therein. Such taper in preferred embodiments is substantially gradually tapering from drywall corner 124 upon which the apparatus is installed away therefrom and away from the V-shaped hinge 150 thereof, all as best shown in FIG. 9**.

Such V-shaped hinge 150 is formed in some embodiments from embossing the V thereof into the material from which first and second plastic strips 136, 138 are formed. Such V-shaped hinge 150 is preferably formed from lines of weakness 157, 157 which are disposed to extend substantially in parallel array and extending longitudinally on the material from which first and second plastic strips 136, 138 are formed, as shown in FIGS. 8 and 11. In such embodiments, a generally centrally disposed line of weakness 159 is disposed in the material of first and second plastic strips 136, 138 to form the bottom of V-shaped hinge 150, as shown in FIGS. 9 and 11, for example. Also in such preferred embodiments, such pair of generally laterally disposed lines of weakness 157, 157 is disposed at substantially equal lateral distances from centrally disposed line of weakness 159 to define the top extent of wings 141, 143 of V-shaped hinge 150. Also in these preferred embodiments, the generally centrally disposed line of weakness 159 may preferably be disposed into one surface of the material from which first and second plastic strips 136, 138 are formed. In the same and other similar embodiments, the pair of generally laterally disposed lines of weakness 157, 157 is also disposed into the opposite surface of the material from which first and second plastic strips 136, 138 is formed, as shown generally in FIG. 9.

Each of the centrally disposed and the pair of generally laterally disposed lines of weaknesses is formed as a longitudinally extending indention within the respective surfaces (i.e., front and back surfaces) of the material from which first and second strips 136, 138 is formed. In these and other preferred embodiments, and as shown in FIG. 9, adhesive means 161 may be applied to at least one side of first and second plastic strips 136, 138 for permitting application thereof to corner 124 to be enforced and for adhesion thereto. Alternatively, first and second plastic strips 136, 138 may be attached by other means to the drywall 127, 129, such as by nailing.

The basic and novel characteristics of the improved apparatus of the present invention will be readily understood from the foregoing disclosure by those skilled in the art. It will become readily apparent that various changes and modifications may be made in the form, construction and arrangement of the improved apparatus of the present invention as set forth hereinabove without departing from the spirit and scope of the invention. Accordingly, the preferred and alternative embodiments of the present invention set forth hereinabove are not intended to limit such spirit and scope in any way.

What is claimed is:

1. An improved flexible corner bead strip for reinforcing a dry wall corner, said corner bead strip comprising:

first and second plastic strips, each having a substantial longitudinal dimension corresponding with the length of the dry wall corner to be reinforced, and each having a transverse dimension defining a corner line formed from the respective central and abutting edges of each of said first and second plastic strips, said first and second plastic strips formed from a first polymeric material having substantial rigidity;

flexible joinder means disposed at said respective central and abutting edges forming said corner line for substantially flexibly securing said first and second plastic strips together and for permitting each of said first and second plastic strips to be bent at a selected angle corresponding to the angle of said dry wall corner for securement thereto to reinforce said dry wall corner, said flexible joinder means comprising a plastic hinge which is substantially V-shaped in transverse cross-section to enhance retention of said first and said second plastic strips in the bent position; and dry wall compound adhering surface means disposed upon at least one of said first and second plastic strips for adhesion of the dry wall compound to the exposed surface in situ of said first and second plastic strips, whereby the dry wall corner may readily, stably and securely be reinforced substantially independently of and regardless of the angle of such corner.

2. The improved flexible corner bead strip of claim 1 wherein said V-shaped plastic hinge is unitarily formed of the same plastic material as that of said first and second plastic strips.

3. The improved flexible corner bead strip of claim 1 wherein said V-shaped hinge is formed from embossing said V thereof into the material from which said first and second plastic strips are formed.

4. The improved flexible corner bead strip of claim 1 wherein each of said centrally disposed line of weakness and said pair of generally laterally disposed lines of weakness are formed as a longitudinally extending indentation within said respective surfaces of the material from which said first and second strips are formed.

5. The improved flexible corner bead strip of claim 1 wherein said first and second plastic strips comprise a vinyl plastic.

6. The improved flexible corner bead strip of claim 1 wherein said dry wall compound adhering surface means further includes apertures therein for receiving dry wall compound therein.

7. The improved flexible corner bead strip of claim 1 further comprising adhesive means disposed upon at least one side of said first and second plastic strips for permitting application thereof to the corner to be reinforced and for adhesion thereto.

8. The improved flexible corner bead strip of claim 1 wherein said V-shaped hinge is formed from disposed lines of weakness extending substantially in parallel array and extending longitudinally on the material from which said first and second plastic strips are formed.

9. The improved flexible corner bead strip of claim 8 wherein a generally centrally disposed line of weakness is disposed in said material from which said first and second plastic strips are formed to form the bottom of said V-shaped hinge.

10. The improved flexible corner bead strip of claim 9 wherein a pair of generally laterally disposed lines of weakness are disposed each at a substantially equal lateral distance from said centrally disposed line of weakness to define the top extent of the said wings of said V-shaped hinge.

11. The improved flexible corner bead strip of claim 10 wherein said generally centrally disposed line of weakness is disposed into one surface of the material from which said first and second plastic strips are formed, and said pair of generally laterally disposed lines of weakness is disposed into the opposite surface of the material from which said first and second plastic strips is formed.

12. The improved flexible corner bead strip of claim 1 wherein said V-shaped plastic hinge comprises a pair of joined wings, and said V-shaped plastic hinge is attached to each of said first and second plastic strips at the distal portion of each of said wings of said V-shape.

13. The improved flexible corner bead strip of claim 12 wherein the exterior surface of said wing and of the attached plastic strip when in the bent position and as installed on an exterior corner, forms drywall compound adhering surface means.

14. The improved flexible corner bead strip of claim 13 wherein said dry wall compound adhering surface is disposed adjacent the exterior corner for enhanced retention of the joint compound thereon.

15. The improved flexible corner bead strip of claim 13 wherein said drywall compound adhering surface is deeper in areas immediately adjacent said wings of said V-shaped hinge and tapers to a shallower depth in areas laterally away from said wings of said V-shaped hinge to provide for a thicker application of drywall compound near the exterior corner and tapering in thickness laterally away therefrom.

16. The improved flexible corner bead strip of claim 5 wherein said taper of said depth of said drywall compound adhering surface is substantially gradually away from said V-shaped hinge thereof.

* * * * *